United States Patent [19]

Birkin

[11] 3,937,432

[45] Feb. 10, 1976

[54] TRAIN CONTROL

[75] Inventor: Michael S. Birkin, Derby, England

[73] Assignee: British Railways Board, London, England

[22] Filed: June 21, 1974

[21] Appl. No.: 481,937

[30] Foreign Application Priority Data

June 21, 1973 United Kingdom ..... 29572/73

[52] U.S. Cl. ..... 246/187 B; 104/88; 246/167 R

[51] Int. Cl.[2] ..... B61L 3/02

[58] Field of Search... 246/167 R, 182 AA, 182 AB, 246/182 B, 182 C, 182 R, 187 B, 63 R, 63 A, 63 C, 253; 104/88

[56] References Cited

UNITED STATES PATENTS

| | | | |
|---|---|---|---|
| 3,054,100 | 9/1962 | Jones | 104/88 |
| 3,268,727 | 8/1966 | Shepard | 246/5 |
| 3,700,886 | 10/1972 | Birkin | 246/167 R |
| 3,736,420 | 5/1973 | Elder et al. | 246/182 AA |
| 3,805,056 | 4/1974 | Birkin | 246/187 B |

*Primary Examiner*—Leo Friaglia
*Assistant Examiner*—David M. Mitchell
*Attorney, Agent, or Firm*—Fred Philpitt

[57] ABSTRACT

This invention relates to a vehicle control system in which a vehicle travels along a fixed trackway, the trackway having one or more divergent portions at which it divides into two or more alternative routes. A plurality of transponders or beacons are positioned adjacent the trackside in advance of each of the divergent portions to pass information to control equipment on the vehicle relating to the running characteristics of one of the alternative routes. A directional radio transmitter is positioned adjacent the divergent portions to transmit information to a receiver linked to the control equipment carried by the vehicle to enable the control equipment to identify the particular transponder or beacon relating to the route to be followed at the divergent portion and to act upon the appropriate information passed from that transponder or beacon.

9 Claims, 2 Drawing Figures

TRAIN CONTROL

In the use of transponders or beacons for transmitting speed control or other information from a trackway to a vehicle, certain problems arise on the approach to diverging junctions. If the two or more routes leading away from the junction are different in their characteristics, say for example they are to be traversed at differing speeds, then some method must be provided to ensure that the information passed to the vehicle is appropriate for the route that is about to be traversed.

A way of achieving this desired state is to provide transponders or beacons which provide the necessary information to the vehicle and which are switched remotely in and out of circuit by means of a cable connected to the control center. This method has the disadvantage that if the beacons or transponders are required to be placed at some distance before the junction, as is often required in railway operations, long and expensive control cable runs are required. In addition it is well known that if it is possible to make the beacons or transponders as sealed units without any outside connections, a significantly greater degree of reliability can be achieved.

The object of the present application is to provide a system for ensuring selection of appropriate beacons or transponders to the route in question. The system may in addition be used to denote changes in trackway information such as a stop or change speed signal for cases other than junctions.

According to the present invention, there is provided a vehicle control system in which a vehicle travels along a fixed trackway, the trackway having one or more divergent portions at which the trackway divides into two or more alternative routes, a plurality of transponders or beacons positioned adjacent the trackside in advance of each of said divergent portions and each adapted to pass information to control equipment on said vehicle relating to the running characteristics of one of said alternative routes, a directional radio transmitter positioned adjacent said divergent portions and adapted to transmit information to a receiver linked to the control equipment carried by said vehicle to enable said central equipment to identify the particular transponder or beacon relating to the route to be followed at said divergent portion, and to act upon the appropriate information passed from said transponder or beacon.

A preferred embodiment of the present invention will now be described with reference to the accompanying drawings in which:-

Figure 1:
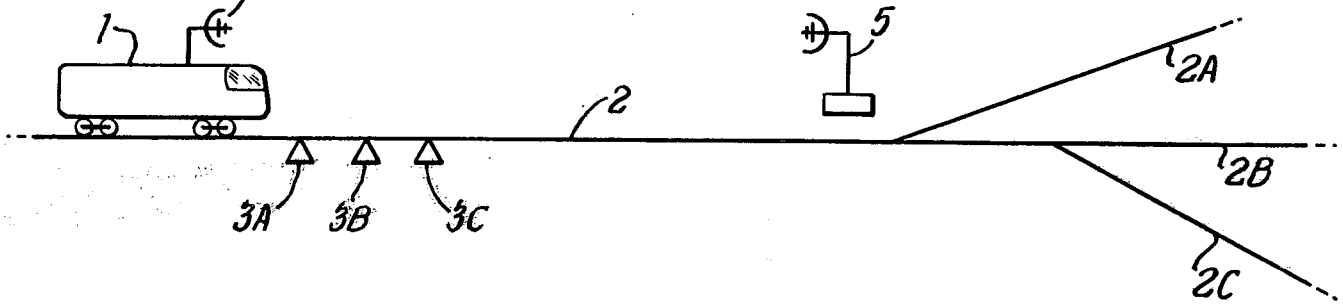
FIG. 1 is a diagrammatic plan view of a trackway junction.

As shown in FIG. 1 a railway vehicle 1 travelling along a trackway 2 is approaching a junction in the track at which the track divides to provide three alternative possible routes 2*a*, 2*b* and 2*c*. A series of transponders or beacons 3*a*, 3*b*, 3*c* are positioned adjacent the track 2, each of which is adapted to receive a triggering signal and to emit a signal containing information regarding the running characteristics of one of the three possible routes 2*a*, 2*b* or 2*c*.

A microwave receiver 4 on the vehicle 1 receives a signal from a directional microwave transmitter 5 at the track junction, which identifies the route about to be traversed by the vehicle and thus informs the control equipment carried by the vehicle as to which one of the transponders or beacons 3 is appropriate to the route about to be traversed.

Figure 2:
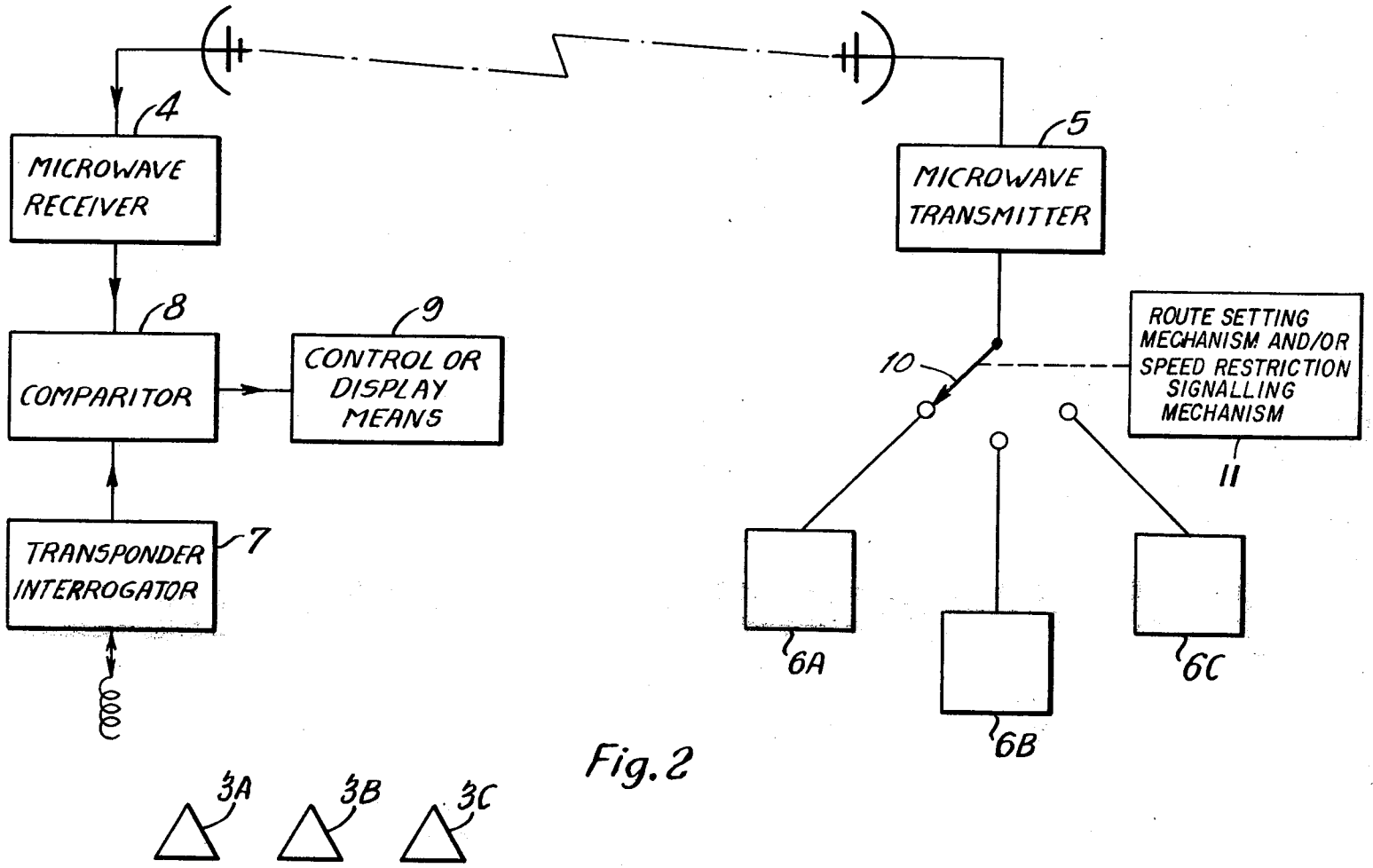
FIG. 2 is a diagrammatic illustration of the apparatus according to the present invention.

FIG. 2 shows in more detail the method of working of the vehicle and trackside equipment. The directional microwave transmitter 5 at the trackside is modulated by information relating to the identity of the route in question. This may be achieved in the case of railway operation by using the position of the points to switch a switching means 10 to an appropriate read-only memory 6*a*, 6*b* or 6*c* containing digital information so as to be connected to the transmitter 5. Each of the read-only memories 6*a*–6*c* contain information as to the identity of one of the routes to be followed and, consequently, of; one of the transponders or beacons 3*a*–3*c* and this information is transmitted to the receiver 4. Switching means 10 is operatively coupled to and operated by route setting mechanism and/or speed restriction signalling mechanism 11, such as the mechanisms disclosed in "Principles of Power Point Control and Detection," Institute of Railway Signal Engineers and "British Railway Signalling," G. M. Kitchenside and A. Williams, Ian Allan, London, respectively;

The output of receiver 4, is compared or matched with transponder identifying signals, which are emitted by each of the transponders 3 and identify the particular transponder which emits the running information for a particular route. This comparison is performed in a comparator 8, adapted to compare the route identifying signal and the transponder identifying signal and pass the running information from the transponder, when the transponder identifying signal agrees with the route identifying signal, to the control or display means 9, for automatically or manually operating the vehicle in accordance with the instructional running information. Suitable digital comparators for this purpose are described in "Electronic Digital Techniques," P. M. Kintner, McGraw Hill, 1968, pp. 159–162. The transponder identifying signal is received by transponder interrogator 7, which sends out signals which trigger the transponders 3 and receives the transponder identifying signals and the instructional running signals from the transponders and passes said signals to the comparator 8 for appropriate operation thereon.

A directional transmission means is used so as to prevent the vehicle from continuing to receive that particular transmission once it has passed the junction.

Failure to detect a microwave transmission corresponding to one of the transponder identities will result in a failure condition being disclosed and if required the vehicle brakes will automatically be applied. Provision can be made for this automatic brake application to be over-ridden by the vehicle driver to enable the vehicle to proceed.

The system according to the invention can be extended to apply additionally to situations in which the information to be passed to the vehicle by the individual transponder or beacons 3*a*–3*c*, is in the form of a speed restriction for the length of track ahead. In this way the vehicle is informed of the appropriate speed at which it should proceed, which speed will vary in dependence upon the presence of proceeding vehicles on the track for example, or to ensure that the vehicle is travelling at the correct speed for a junction to be encountered in the course of the next few miles.

I claim:

1. A vehicle control system, wherein said vehicle travels along a single, first trackway, defining a first route, which thereafter diverges to form a plurality of second trackways, defining a plurality of alternate routes, comprising; a plurality of transponders or beacons disposed adjacent said first trackway in advance of the point of divergence of said second trackways, equal in number to the number of said second trackways and each adapted to be triggered to emit a signal containing information peculiar to the operating characteristics along one of said second trackways; transmitter means disposed adjacent said second trackways and adapted to emit a plurality of individual signals equal in number to the number of said second trackways and each identifying a particular one of said second trackways; receiver means mounted on said vehicle and adapted to operatively communicate with said transmitter and receive said trackway identifying signals when said vehicle is at a location along said first trackway adjacent said transponders; control equipment mounted on said vehicle, operatively coupled to said receiver to receive the output signal thereof and adapted to operatively communicate with said transponders, when said vehicle is at said location along said first trackway adjacent said transponders, to receive an identifying signal, identifying the one of said second trackways said vehicle is to travel along, from said receiver, to send a triggering signal to the one of said transponders which emits a matching signal and a signal containing information peculiar to the operating characteristics along said identified one of said second trackways and to compare said identifying signal with said matching signal, and to utilize the information peculiar to the operating characteristics along said identified one of said second trackways received from said triggered transponder.

2. A system in accordance with claim 1 wherein the transmitter means includes storage means, adapted to individually store each of the signals identifying each of the second trackways, a transmitter adapted to emit said identifying signals and switch means adapted to selectively transmit each of said stored identifying signals from said storage means to said transmitter.

3. A system in accordance with claim 2 wherein the storage means includes a plurality of read-only memories, equal in number to the number of the second trackways.

4. A system in accordance with claim 2 wherein the switch means is operatively coupled to and operated by a route setting mechanism.

5. A system in accordance with claim 2 wherein the switch means is operatively coupled to and operated by a speed restriction signalling mechanism.

6. A system in accordance with claim 1 wherein the control equipment includes a transponder interrogator adapted to emit the transponder triggering signal and to receive the signal containing information peculiar to the operating characteristics along one of the second trackways which is emitted by the triggered transponder.

7. A system in accordance with claim 1 wherein each of the transponders is also adapted to emit a matching signal matching the signal, emitted by the transmitter, which identifies a particular one of the second trackways and the control equipment includes a comparator adapted to compare said trackway, identifying signal from said transmitter with said matching signal from the transponder.

8. A system in accordance with claim 7 wherein the comparator is also adapted to transmit the signal containing information peculiar to the operating characteristics of a particular one of the second trackways from the triggered transponder to a display means for operating the vehicle mannually.

9. A system in accordance with claim 7 wherein the comparator is also adapted to transmit the signal containing information peculiar to the operating characteristics of a particular one of the second trackways from the triggered transponder to a control means for automatically operating the vehicle.

* * * * *